US006267140B1

(12) United States Patent
Hayashi et al.

(10) Patent No.: US 6,267,140 B1
(45) Date of Patent: Jul. 31, 2001

(54) DIRECTIONAL CONTROL VALVE HAVING POSITION DETECTING FUNCTION

(75) Inventors: Bunya Hayashi; Makoto Ishikawa, both of Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/589,803

(22) Filed: Jun. 9, 2000

(30) Foreign Application Priority Data

Jul. 12, 1999 (JP) ..... 11-197777

(51) Int. Cl.[7] ..... F15B 13/043

(52) U.S. Cl. ..... 137/554; 137/625.64; 137/625.65; 137/884

(58) Field of Search ..... 137/554, 625.64, 137/625.65, 884

(56) References Cited

U.S. PATENT DOCUMENTS 4,953,590 * 9/1990 Kakinuma et al. ..... 137/554
5,101,856 * 4/1992 Kakinuma et al. ..... 137/554
5,244,002 * 9/1993 Frederick ..... 137/1
5,320,123 * 6/1994 Corso et al. ..... 137/1
5,623,967 4/1997 Hayashi ..... 137/625.64

FOREIGN PATENT DOCUMENTS 2-66784 5/1990 (JP) .
2-66785 5/1990 (JP) .
2-88079 7/1990 (JP) .

* cited by examiner

*Primary Examiner*—A. Michael Chambers
(74) *Attorney, Agent, or Firm*—Oblon, Spivak, McClelland, Maier & Neustadt, P.C.

(57) ABSTRACT

A directional control valve capable of detecting the operating positions over the whole stroke of the valve member. The control valve includes a detection head having a magnetic scale including a magnetic portion and a non-magnetic portion installed on an end of a spool, and a magnetic sensor for reading the magnetic scale installed at a predetermined position opposite to the magnetic scale in a casing.

7 Claims, 4 Drawing Sheets

DIRECTIONAL CONTROL VALVE HAVING POSITION DETECTING FUNCTION

TECHNICAL FIELD

The present invention relates to a directional control valve having a position detecting function, capable of detecting operating positions of a valve member such as a spool.

BACKGROUND ART

The directional control valve capable of detecting the changeover operation of a spool utilizing a magnet is well known as disclosed in, for example, Japanese Unexamined Utility Model Publication No. 2-66784. This known directional control valve is provided with a magnet on the outer periphery of a spool and provided with a magnet sensor on a casing. This directional control valve is arranged so that, when the spool moves to one changeover position, the magnet approaches the magnetic sensor, and the magnetic sensor is turned on, and that, when the spool moves to the other changeover position, the magnet moves away from the magnetic sensor, and the magnetic sensor is turned off. Thus, this directional control valve detects that the spool has been changed over by one on/off of the magnetic sensor.

However, since the above-described conventional directional control valve uses the method in which a magnetic sensor outputs the detection signal of "on" or "off" when the spool have arrived at a spool end, this directional control valve can not detect positions of the spool on the way of a stroke, even though it can detect the position of the spool situated at a stroke end. Therefore, even if the spool makes an irregular movement deficient in smoothness due to some abnormality on the way of a stroke, it is impossible to detect this abnormality. This has made it difficult to take suitable precautions against a failure or an accident before they happen, and has thus raised a problem in the maintenance and management.

In addition, the above-described magnetic sensor is generally constituted so as to be turned on when the magnetic flux density is above a fixed value, and to be turned off when it is below another fixed value. Therefore, during the driving stroke of the spool, if the magnetic flux density becomes higher than the fixed value due to the approach of a magnet, the magnetic sensor is turned on even before the spool arrives at a stroke end, and conversely, during the return stroke of the spool, if the magnetic flux density becomes lower than the other fixed value due to the moving-away of the magnet, the magnetic sensor is turned off even before the spool arrives at the return-stroke end. Therefore, even if the magnetic sensor stops on the spot for some reason at the instant when the magnetic sensor is turned on or turned off, the magnetic sensor only outputs an on/off signal noticing that the spool has been completely changed over. Thus, any abnormality can not be detected.

Furthermore, since the above-described conventional directional control valve installs the magnet at a position situated in the fluid passage on the outer periphery of the spool, the magnet directly contacts a hydraulic fluid. Therefore, if the fluid contains water, chemical mist, particulates of magnetic material such as metallic powder, or the like, there would arise the problem that the contact of the magnet with these substances makes the magnet rust, corrode, or adsorb the particulates, thereby causing the reduction in detection accuracy due to the decrease in magnetic force, or incurring a malfunction of the valve member due to adsorbed particulates.

DISCLOSURE OF INVENTION

The main technical problem of the present invention is to provide a directional control valve having a position detecting function capable of detecting the operating positions of the valve member over the le stroke thereof.

The subordinate technical problem of the present invention is to prevent the components constituting the position detecting means in the above-described directional control valve from contacting hydraulic fluid to exclude the influence of the hydraulic fluid, and to maintain an excellent detecting accuracy and operational stability.

In order to solve the above-described problems, the directional control valve of the present invention mounts a magnetic head having a magnetic scale so as to be displaced together with the valve member, and fixedly installs a magnetic sensor for reading the magnetic scale at a portion of the casing In accordance with the directional control valve of the present invention having above-described features, since pulse-shaped detection signals are outputted from the magnetic sensor by reading the magnetic scale moving together with the valve member, the operating positions of the valve member over the whole stroke thereof can be detected by counting the signals. From the relations between the operating position and the operating time, therefore, it is possible to discriminate whether the valve member has normally operated or not, and to take suitable precautions against a failure or an accident before they happen.

In the present invention, it is preferable that the above-mentioned detection head is disposed at a position shut off from the fluid passages, such as a breathing chamber at an end portion of the valve member.

Thereby the magnetic scale can be prevented from directly contacting the hydraulic fluid. Therefore, even if the hydraulic fluid contains water, chemical mist, particles of magnetic material such as metallic particles, or the like, there is no risk of the magnetic scale rusting, corroding, or adsorbing magnetic particulates. This prevents the occurrence of the reduction in function, or a malfunction of the valve member due to adsorbed particulates.

In accordance with a specific embodiment of the present invention, the above-described detecting head has a construction so that a magnetic scale is affixed on the outer surface of a cylindrical-column shaped substrate, and installed on an end portion of the valve member coaxially with the valve member.

In accordance with another specific embodiment of the present invention, the above-described directional control valve has a piston which is disposed on at least one end side of the valve member and which operates by the action of pilot fluid pressure to change over the valve member, and these proton and valve member are abutted against each other via the detection head.

Moreover, in accordance with the present invention, the above-described sensor is formed of a magnetic resistance element and is constituted so as to output two analog signals different in phase from each other, upon reading the magnetic scale. In addition, the above-mentioned casing is provided with a signal processing circuit, which includes an amplifying circuit for amplifying the read signals from the sensor and a dividing circuit for dividing the amplified signal into a plurality of pulse signals to be outputted.

DETAILED DESCRIPTION OF THE INVENTION

Figure 1:
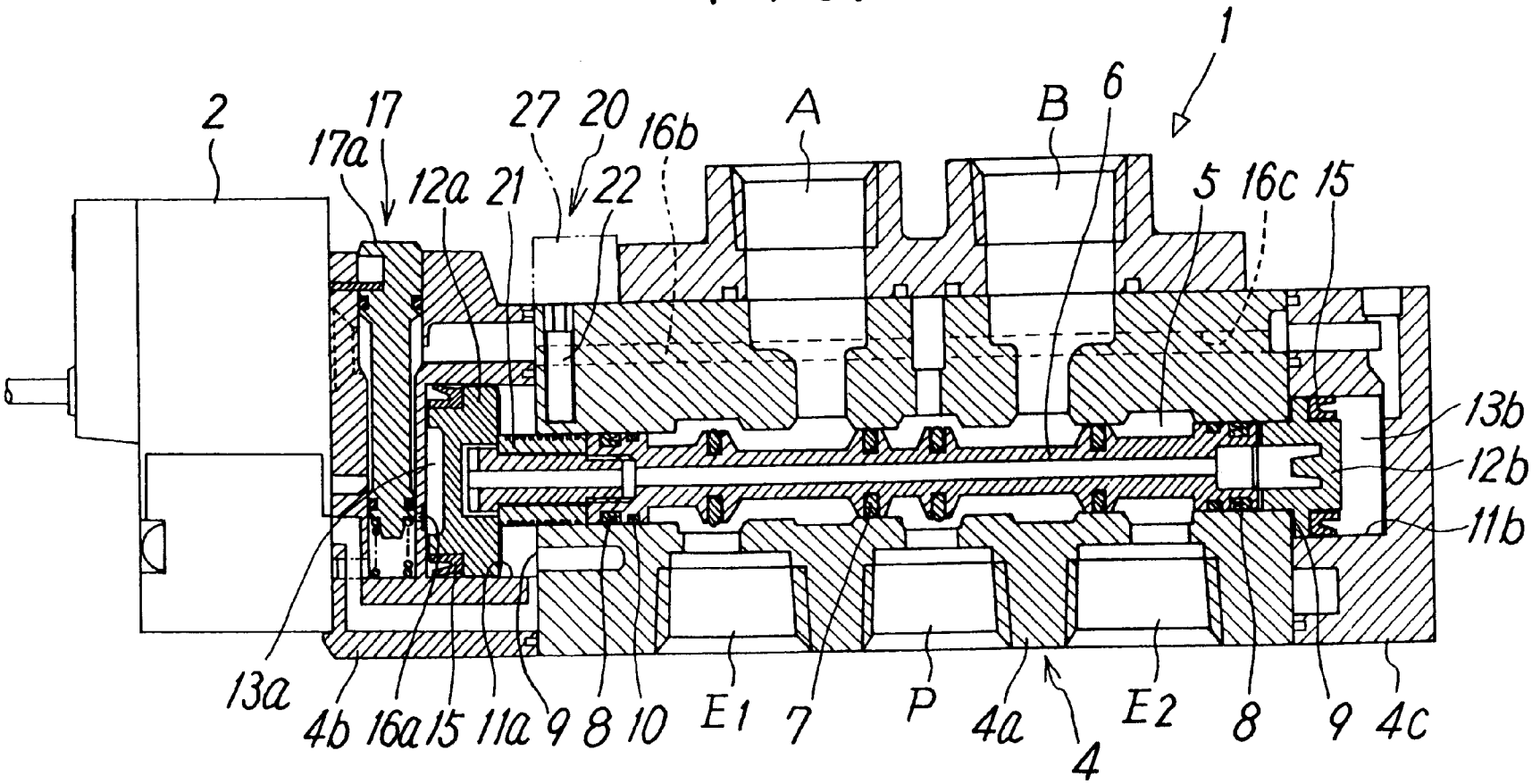
FIG. 1 is a longitudinal sectional view of a first embodiment of the directional control valve in accordance with the present invention.

FIG. 1 shows the first embodiment of the directional control valve in accordance with the present invention. The directional control valve here exemplified is a single-pilot type directional control valve wherein a main valve 1 is changed over by one pilot valve 2.

The main valve 1 has a construction as a 5-port valve, and includes a casing 4 constructed of non-magnetic material. The casing 4 comprises a first member 4*a* of cuboid shape, a second member 4*b* which is connected to the one end of the first member 4*a* and which also serves as an adapter for mounting the pilot valve 2, and a third member 4*c* which is connected to the other end of the first member 4*a* and which functions as an end cover.

A supply port P and two discharge ports E1 and E2 are provided on either of the upper and lower surfaces of the first member 4*a*, and two output ports A and B are provided on the other surface. Inside the first member 4*a*, there is provided a valve hole 5 to which these ports are each opened being arranged in the axial direction. In the valve hole 5, there is slidably received a spool 6 which is a valve member for changing over flow passages.

On the outer periphery of the spool 6, there are provided a plurality of sealing members 7 for mutually defining flow passages connecting the above-mentioned ports, and on the outer peripheries of both ends of the spool 6, there are provided respective end sealing members 8 for shutting off the breathing chambers 9 facing the ends of the spool 6, from some flow passages. Reference numeral 10 in FIG. 1 denotes a guide ring for stabilizing the sliding of the spool 6.

On the other hand, in the second member 4*b* and the third member 4*c*, the piston chamber 11*a* and 11*b* are formed, respectively, at the positions facing both ends of the spool 6. A first piston chamber 11*a* formed in the second member 4*b* has a large diameter, and a first piston 12*a* of large diameter is slidably received in the piston chamber 11*a*, while a second piston chamber 11*b* formed in the third member 4*c* has a smaller diameter than the first piston chamber 11*a*, and a second piston 12*b* of small diameter is slidably received in the piston chamber 11*b*. Out of these pistons, the second piston 12*b* directly abuts against the end face of the spool 6, while the first piston 12*a* abuts against the end face of the spool 6 via the detection head 21 forming a part of a position detecting mechanism 20.

On the back sides of the pistons 12*a* and 12*b*, that is, on the sides opposite to the end faces of the pistons abutting against the spool 6, first and second pilot pressure chambers 13*a* and 13*b* are formed, respectively. Between the pistons 12*a* and 12*b*, and the end faces of the spool 16, there are formed breathing chambers 9 and 9 which are opened to the outside, respectively. The pressure chambers 13*a* and 13*b* are hermetically shut off from the breathing chambers 9 and 9 by piston packing 15 and 15 mounted on the outer peripheries of the piston 12*a* and 12*b*, respectively.

The first pressure chamber 13*a* situated adjacent to the first piston 12*a* of large diameter communicates with the supply port P through the pilot fluid passages 16*a* and 16*b* via the above-mentioned pilot valve 2 and a manual operating mechanism 17, while the second pressure chamber 13*b* situated adjacent to the second piston 12*b* of small diameter always communicates with the supply port P through the pilot fluid passage 16*c*.

When the pilot valve 2 is in the "off" state, that is, when the first pressure chamber 13*a* is not supplied with a pilot fluid, the second piston 12*b* is pushed by the pilot fluid pressure supplied to the second pressure chamber 13*b*, so that the spool 6 is situated at the first changeover position shifted to the left side, as shown in FIG. 1. Once the pilot valve 2 is turned "on", that is, the first pressure chamber 13*a* is supplied with a pilot fluid, the spool 6 is pushed by the first piston 12*a*, so that the spool 6 moves to the right side and occupies the second changeover position. This is because the acting force of fluid pressure acting on the first piston 12*a* is larger than that acting on the second piston 12*b* due to the difference in the pressure receiving area between the two piston 12*a* and 12*b*.

The above-mentioned manual operating mechanism 17 is adapted to directly connect the pilot fluid passages 16*a* and 16*b* by depressing an operating element 17*a*, and to thereby make the first pressure chamber 13*a* communicate with the supply port P. This operating state is the same as that in which the pilot valve 2 is "on".

The pilot valve 2 is an electromagnetically operated solenoid valve for opening/closing a pilot fluid passage by energizing a solenoid. Since its constitution and operation are the same as the known one, specific explanation thereof is omitted.

The above-described directional control valve is provided with the above-mentioned position detecting mechanism 20 for detecting operating positions of the spool 6. The position detecting mechanism 2 comprises a detection head 21 mounted on the spool 6 and a magnetic sensor 22 which is fixedly installed at a predetermined position adjacent to the casing 4 and which reads the magnetic scale on the detection head 21.

Figure 2:
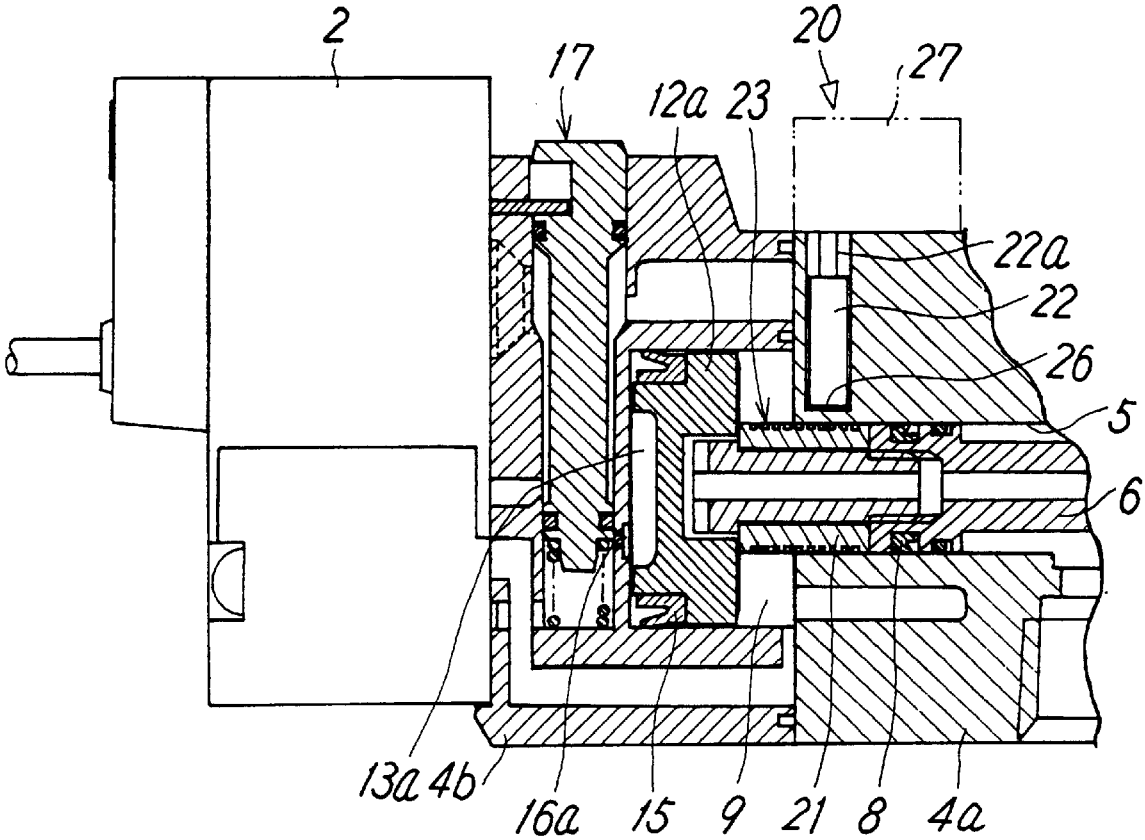
FIG. 2 is an enlarged view showing the main section of FIG. 1.
Figure 3:
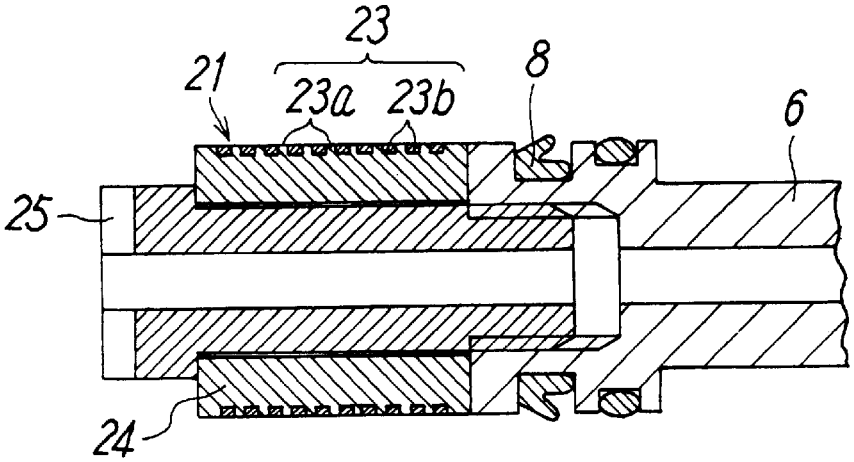
FIG. 3 is a longitudinal cross sectional view of the main section showing the detail of a method for coupling the spool and the detecting head.
Figure 4:
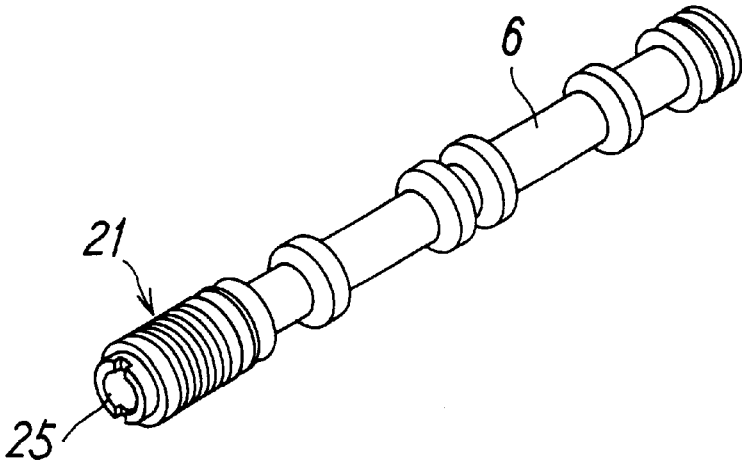
FIG. 4 is a perspective view showing the spool in its entirety.

As shown in FIGS. 2 through 4, the detection head 21 has the magnetic scale 23 which alternately disposes magnetic portions 23*a* and non-magnetic portions 23*b* at a constant pitch (i.e., 0.8 mm pitch) in the axial direction, on the outer surface of a substrate 24 of a cylindrical column shape having a small diameter slightly smaller than or equal to that of the end portion of the spool 6, and is installed, with the aid of a plug 25 inserted into the detection head, at a position which faces the breathing chamber 9 and which is situated on an end of said valve member so as to be coaxial with the spool 6.

In order to form the magnetic scale 23, magnetic bodies may be imbedded at a regular interval in the outer surface of the substrate 24 formed of non-magnetic material, or conversely, non-magnetic bodies may be imbedded at a regular interval in the outer surface of the substrate 24 formed of magnetic material. When imbedding the magnetic bodies or the non-magnetic bodies, as shown in drawings, annular bodies may be imbedded so as to surround the whole circumference of the substrate 24, or short-line shaped bodies may be partially imbedded in necessary area only out of all outer surface substrate 24.

Thus, by disposing the detection head 21 at a position facing the breathing chamber 9, shut off from the hydraulic fluid passages by the end sealing member 8, the magnetic scale 23 is prevented from contacting the hydraulic fluid. Therefore, even if the hydraulic fluid contains water, chemical mist, magnetic particles such as metallic powder, or the like, there is no risk of the magnetic scale 23 rusting, corroding, or adsorbing magnetic bodies due to the contact with these substances. This prevents the reduction in detecting accuracy due to the decrease in magnetic force, or the occurrence of a malfunction of the spool 6 due to adsorbed particulates.

On the other hand, the magnetic sensor 22 is installed at a position adjacent to the magnetic scale 23, in the housing 26 formed in the first member 4*a* of the casing 4, so as to be able to detect the magnetic scale 23 on the detection head 21 over the whole stroke of the spool 6. In this case, by opening the tip end of the housing 26 to the valve hole 5 at the position adjacent to the breathing chamber 9, more exterior than the end sealing member 8, the magnetic sensor 22 may be made to directly face to the magnetic scale 23. Even when the housing 26 is thus opened to the valve hole 5 at the position communicating with the breathing chamber 9, there is no risk of the hydraulic fluid leaking.

As the magnetic sensor 22, a magnetic resistance element that is changed in electric resistance by magnetic force is suitably utilized. This magnetic sensor is connected to a signal processing circuit 27 with a lead wire 22*a*. The signal processing circuit 27 comprises an amplifying circuit for amplifying the read signals from the magnetic sensor 22 and a dividing circuit for dividing an amplified signal into a plurality of signals to be outputted, and detects positions of the spool on the principle as follows. Here, the signal processing circuit 27 may be installed at any suitable position on a casing 4, as shown in drawings.

Figure 6:
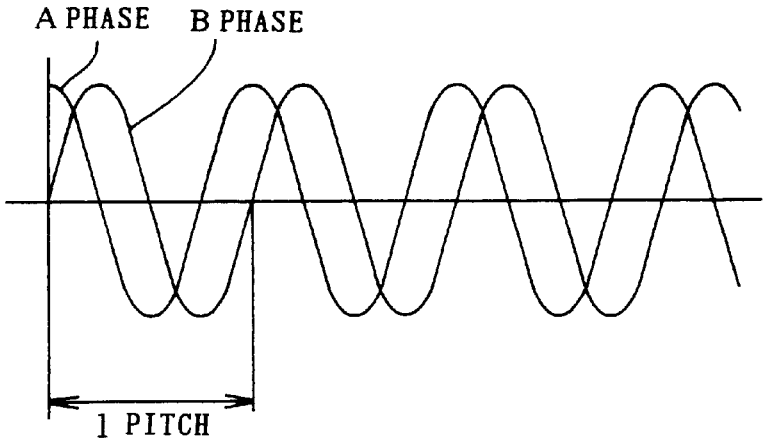
FIG. 6 is a diagram showing detection signals from the magnetic sensor.

Once the magnetic sensor 22 reads the magnetic scale 23 moving together with the spool 6, the magnetic sensor 22 outputs a two-phase signal consisting of A and B phases having sin/cos waveforms as shown in FIG. 6. A cycle of these waveforms corresponds to one pitch of the magnetic scale.

Figure 7:
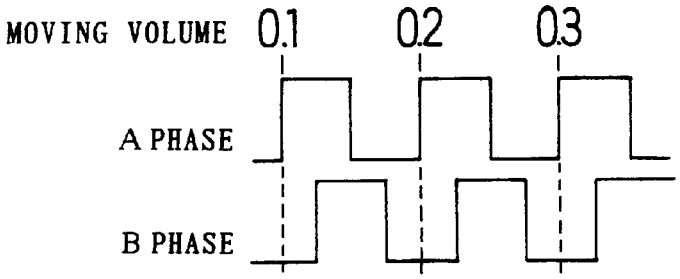
FIG. 7 is a diagram showing pulse signals obtained by dividing the amplified signal into a plurality of signals.

After being sent to the signal processing circuit and amplified by the amplifying circuit, the above-described signal is divided into a plurality of signals, and pulse signals as shown in FIG. 7 is outputted toward a controller (not shown). By counting these pulses by a counter, the operating position of the spool can be detected.

For example, in the case where the magnetic scale 23 is marked at pitches of 0.8 mm, if a signal from the magnetic sensor 22 is amplified and then divided into eight, a pulse signal (0.1 mm/pulse) having a phase difference 90 is outputted, and consequently, the position of the spool can be detected with a resolution of 0.1 mm. Furthermore, if a signal is divided twenty, the position of the spool can be detected with a high resolution of 0.04 mm.

Therefore, by previously inputting data necessary for automatic control or maintenance, such as the relations between the operating position and the operating time when the spool 6 normally operates, and by comparing the detected results with these data, it is possible to discriminate whether the operation of the spool 6 has been normal or abnormal. This permits the prediction of a sign of failure, and taking precautionary measures against a failure before it happens. Thereby an situation such that the operation of device stops for a long time due to the occurrence of a failure or an accident can be prevented.

Herein, the operating positions, the operating times, etc. which have been detected for the piston 12*a* can be displayed on a display device in form of numeral values or graphs.

Figure 5:
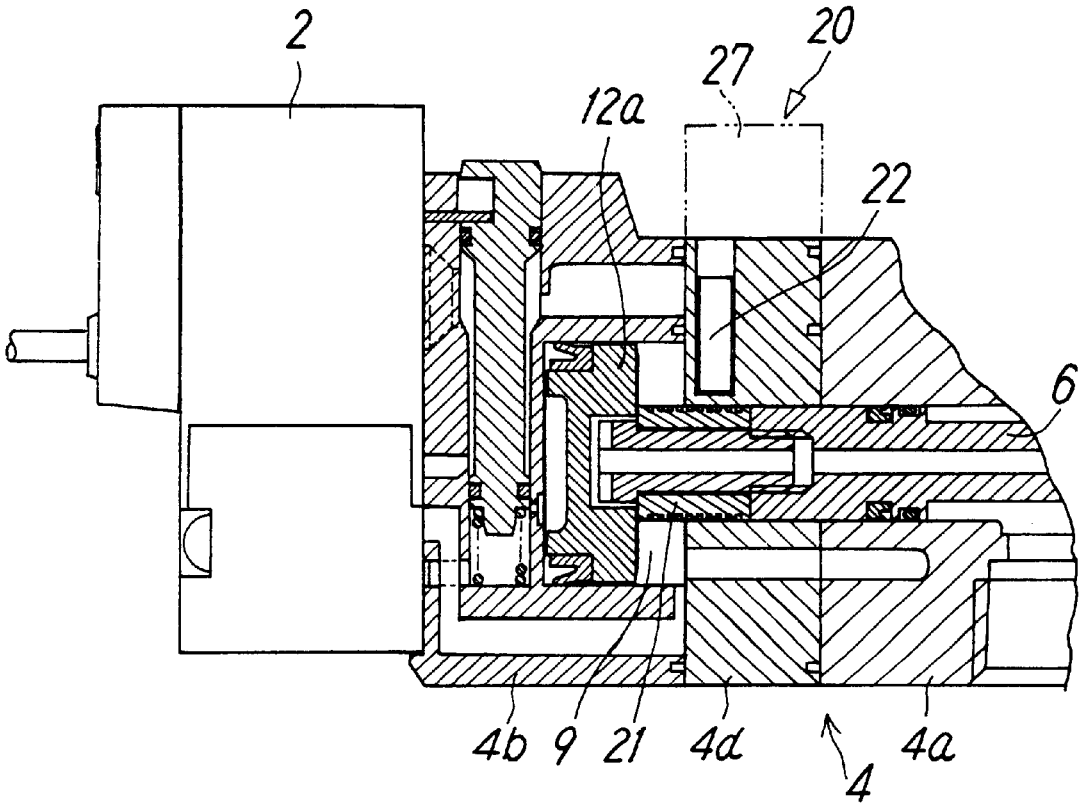
FIG. 5 is a longitudinal sectional view showing the main section of a second embodiment of the present invention.

FIG. 5 shows the second embodiment of the present invention. The difference between the above-described first embodiment and the second embodiment is that in the first embodiment the magnetic sensor 22 is directly installed on the first member 4*a* of the casing 4, whereas in the second embodiment the forth member 4*d* dedicated to sensor mounting is interposed between the first member 4*a* and the second member 4*b*, and the magnetic sensor 22 is installed on this forth member 4*d*.

Since constitutions and operations of the second embodiment other than the foregoing are substantially the same as those of the first embodiment, description thereof is omitted.

In each of the above-described embodiments, as the valve member, a spool was shown, but the valve member is not limited to a spool. For example, even if the valve member is of poppet type, the present invention may be applied to it, if it has, on at least one end side, a sliding portion for sliding in the valve hole and a breathing chamber, and if it has, on this sliding portion, an end sealing member for shutting off the breathing chamber from the flow passages.

Furthermore, the type of the directional control valve is not particularly limited to the single-pilot type as in the above-described embodiments, but a double-pilot type directional control valve may be used, or a direct-acting type directional control valve in which the valve member is directly driven by electromagnetic or mechanical driving means may be employed.

As has been described hereinbefore in detail, in accordance with the present invention, by disposing a magnetic scale which is displaced in synchronization with the valve member, and a magnetic sensor for reading the magnetic scale, it is possible to detect the operating positions over the whole stroke.

Moreover, in accordance with the present invention, by disposing the magnetic scale at a position shut off from the hydraulic fluid passages, the magnetic scale can be prevented from contacting the hydraulic fluid. Therefore, even if the hydraulic fluid contains water, chemical mist, magnetic particles such as metallic powders, or the like, the magnetic scale can be prevented from rusting, corroding, or adsorbing magnetic particles, which permits the maintaining of an excellent detecting accuracy and operational stability.

What is claimed is:

1. A directional control valve having a position detecting function, comprising:

a plurality of ports;

a valve hole to which each of said ports is opened;

a casing having said ports and said valve hole;

a valve member for changing over fluid passages, said valve member being slidably received in said valve hole;

driving means for driving said valve member;

a detection head which has a magnetic scale formed so as to have a length corresponding to the whole stroke of said valve member by alternately disposing magnetic portions and non-magnetic portions, and which is displaced in synchronization with said valve member; and a magnetic sensor for reading the magnetic scale of said detection head, said magnetic sensor being disposed at that portion in the casing corresponding to said detection head.

2. A directional control valve as claimed in claim 1, wherein said detection head is disposed at a position shut off from fluid passages.

3. A directional control valve as claimed in claim 2, wherein the position where said detection head is installed in the state shut off from the fluid passages is a breathing chamber which is formed at the position facing an end face of said valve member and which is opened to the outside, and wherein said detection head has a construction such that said magnetic scale is affixed on the outer surface of said cylindrical-column shaped substrate, said detection head being disposed on an end portion of said valve member coaxially with said valve member.

4. A directional control valve as claimed in claim 3, further comprising:

a piston for changing over said valve member by operating under the action of a pilot fluid pressure, said piston being disposed at least on the side where said detection head is mounted, out of both ends of said valve member;

wherein said piston and said valve member are abutted against each other via said detection head.

5. A directional control valve as claimed in claim 1, wherein said detection head has a construction such that a magnetic scale is affixed on the outer surface of a cylindrical-column shaped substrate, said detection head being disposed on an end portion of said valve member coaxially with said valve member.

6. A directional control valve as claimed in claim 5, further comprising:

a piston for changing over said valve member by operating under the action of a pilot fluid pressure, said piston being disposed at least on the side where said detection head is mounted, out of both ends of said valve member;

wherein said piston and said valve member are abutted against each other via said detection head.

7. A directional control valve as claimed in claim 1, wherein said sensor is formed of a magnetic resistance element, said sensor being constituted so as to output two analog signals different in phase from each other, upon reading the magnetic scale, and wherein said casing is provided with a signal processing circuit, which comprises an amplifying circuit for amplifying the read signal from the sensor and a dividing circuit for dividing the amplified signal into a plurality of pulse signals to be outputted.

* * * * *